US005324610A

United States Patent [19]

Tanaka et al.

[11] Patent Number: 5,324,610

[45] Date of Patent: Jun. 28, 1994

[54] ELECTROPHOTOGRAPHIC ORGANIC PHOTOSENSITIVE MATERIAL WITH DIPHENOQUINONE DERIVATIVE

[75] Inventors: Masashi Tanaka, Kishiwada; Tadashi Sakuma; Toshiyuki Fukami, both of Sakai; Hideo Nakamori, Osaka, all of Japan

[73] Assignee: Mita Industrial Co., Ltd., Osaka, Japan

[21] Appl. No.: 857,653

[22] Filed: Mar. 26, 1992

[30] Foreign Application Priority Data

Mar. 26, 1991 [JP] Japan ..... 3-61436
Jun. 7, 1991 [JP] Japan ..... 3-136790
Aug. 19, 1991 [JP] Japan ..... 3-207063

[51] Int. Cl.[5] ..... G03G 5/09

[52] U.S. Cl. ..... 430/83; 430/58; 430/59

[58] Field of Search ..... 430/58, 59, 83

[56] References Cited

U.S. PATENT DOCUMENTS 4,243,601 1/1981 Yoshida et al. ..... 549/35 X
4,264,695 4/1981 Kozima et al. ..... 430/58
4,302,521 11/1981 Takei et al. ..... 430/58 X
5,166,016 11/1992 Badesha et al. ..... 430/72 X
5,168,026 12/1992 Miyamoto ..... 430/73
5,213,923 5/1993 Yokoyama et al. ..... 430/58

FOREIGN PATENT DOCUMENTS 0426445 5/1991 European Pat. Off. .
206349 8/1989 Japan .

OTHER PUBLICATIONS

Database WPIL, Week 9201, Derwent Publications Ltd., London, GB; AN 92-003115 (01) & JP-A-3 256 050 (Mita Ind KK) Nov. 14, 1991.
Patent Abstracts of Japan, vol. 9, No. 137 (P-363) Jun. 12, 1985 & JP-A-60 019 154 (Hitachi Seisakusho KK) Jan. 31, 1985.
Database WPIL, Week 9108, Derwent Publications Ltd., London, GB; AN91-053477 (08) & JP-A-2 300 759 (Canon KK) Dec. 12, 1990.

*Primary Examiner*—Roland Martin
*Attorney, Agent, or Firm*—Sherman and Shalloway

[57] ABSTRACT

The organic photosensitive material for electrophotography in accordance with this invention is characterized in that a non-symmetrically substituted diphenoquinone derivative represented by the following formulae or (Abstract continued on next page.)

-continued
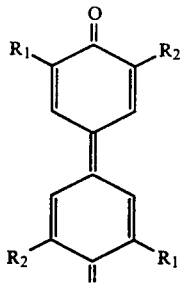
wherein each of $R_1$ and $R_2$ represents an alkyl or aryl group, $R_2$ having larger carbon atoms than $R_1$, is used as an electron transporting agent. This photosensitive material has a residual potential limited to a low level, and shows excellent sensitivity in both positive charging and negative charging.
20 Claims, 4 Drawing Sheets

ELECTROPHOTOGRAPHIC ORGANIC PHOTOSENSITIVE MATERIAL WITH DIPHENOQUINONE DERIVATIVE

BACKGROUND OF THE INVENTION

1. Field of the Invention

This invention relates to an electrophotographic organic photosensitive material to be used in a copying machine, a laser printer, etc. More specifically, it relates to an electrophotographic organic photosensitive material capable of positive charging or both the positive and the negative chargings and having an improvement in sensitivity and residual potential.

2. Description of the Prior Art

For electrophotographic copying using a digital optical system a light source having a wavelength of usually at least 700 nm is used. Organic photosensitive materials (OPC), amorphous silicon (α-Si) and some selenium photosensitive materials are known as photosensitive materials having a sensitivity in this wavelength region. From the overall viewpoint of sensitivity and cost, OPC is used mostly in this field.

Although there are many so-called function separation-type organic photosensitive materials, i.e. laminated-type photosensitive materials, obtained by laminating a charge generating layer (CGL) and a charge transporting layer (CTL) as organic photosensitive material, there has been already known a single layer dispersed type organic photosensitive material wherein a charge generating substance is dispersed in a medium of a charge transporting substance.

A charge generating substance of this kind of photosensitive material having a high carrier movability is required. But since the charge transporting agent having a high carrier movability are mostly a positive hole transporting, what is actually used is limited to negative chargeable organic photosensitive materials. However, as the negative chargeable organic photosensitive materials utilizing a negative polarity corona discharging, there is much ozone development and it contaminates the environment. A problem of degradation of the photosensitive materials also arises. To prevent them, particular charging systems are required such as a particular charging system of not generating ozone, a system of decomposing the generated ozone and a system of evacuating ozone within the apparatus, and this has the defect of complicating the process or systems.

There has been proposed in the Japanese unexamined patent publication No. 206349/89 a compound having a diphenoquinone structure as a charge transporting agent for an electrophotographic sensitive material which is exemplified as a rare charge transporting substance having an electron transportability.

The diphenoquinone mentioned above has good compatibility with a binder resin, and is said to show good electron transporting ability. However, the laminated photosensitive material having this diphenoquinone derivative still is defective of not having either a high residual potential or a sufficient sensitivity for practical application.

On the other hand, as regards the charging polarity of a photosensitive material, if it can be used both in positive charging, further, if it can be used in both the positive charging and the negative charging, the range of application of the photosensitive material can further be broadened, and it may be markedly advantageous in removing many above-mentioned defects. Furthermore, if the organic photosensitive material can be used in a single layer dispersion-type, it facilitates a production of the photosensitive material and many advantages can be achieved in preventing the occurrence of film defects and improving optical characteristics.

SUMMARY OF THE INVENTION

The present inventors discovered that a residual potential of the photosensitive material was decreased and an improvement of sensitivity was brought about by selecting a positive hole transporting agent having a specified ionized potential, combining it with a diphenoquinone derivative as an electron transporting agent, particularly a non-symmetrical type, and dispersing the mixture in a resin binder to form a single layer dispersion-type organic photosensitive material.

The present inventors further have found that diphenoquinone derivatives, above all non-symmetrical substituted-type diphenoquinone, can be included in a high concentration in the binder resin, and when it is included in a high concentration of 10 to 60% by weight in the electron transporting layer, an electrophotographic organic laminated photosensitive material can be obtained which has a high initial potential, a low residual potential, an improved sensitivity and excellent durability. The present inventors also found that when a charge generating agent having a specified ionized potential is selected as a charge (electron) generating layer and combined with a transporting layer of a non-symmetrically substituted diphenoquinone derivative, the residual potential of the photosensitive material can be further decreased, and the sensitivity can be further increased.

It is an object of this invention to provide an electrophotographic organic photosensitive material, which is a single layer dispersion-type or a laminated-type, can be charged positively or both positively and negatively, has a residual potential inhibited at a low level, and shows excellent sensitivity to the above charging.

According to this invention, there is provided n electrophotographic organic photosensitive material composed of a single layer dispersion-type organic photosensitive layer on an electroconductive substrate, the organic photosensitive layer being composed of a charge generating agent dispersed in a resin binder, a diphenoquinone derivative as an electron transporting agent and a hole transporting agent having an ionized potential of 5.3 to 5.6 eV.

There is also provided the photosensitive material in which the charge generating agent is composed of a charge generating pigment having an ionized potential of 5.3 to 5.6 eV.

Preferred diphenoquinone derivatives are non-symmetrical substituted type, particularly those represented by formula (1), (2) and (3).

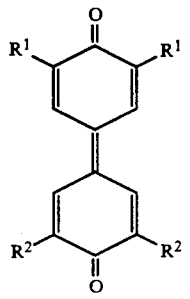

(1)

-continued (2)

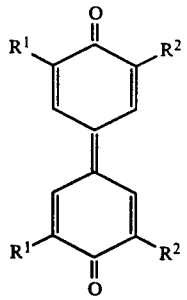

(3)

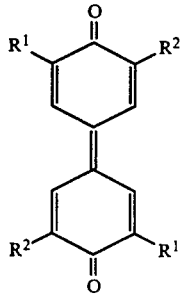

In the above formulae, each of $R^1$ and $R^2$ is an alkyl or aryl group, the group $R^2$ having larger carbon atoms than the group $R^1$.

Furthermore, according to the present invention, in an electrophotographic organic laminated photosensitive material composed of an electroconductive substrate and a charge generating layer and an electron transporting layer in this order, the electron transporting layer contains a non-symmetrically substituted diphenoquinone derivative as the electron transporting agent in a proportion of 10 to 60% by weight based on the total amount of the resin and the electron transporting agent.

DETAILED DESCRIPTION OF THE INVENTION

Single Layer Dispersed-Type Organic Photosensitive Material

As already pointed out, according to this invention, a hole transporting agent having an ionized potential of 5.3 to 5.6 eV, particularly 5.32 to 5.56 eV, measured by an atmospheric photoelectric analyzing apparatus (AC-1, made by Riken Instrument Co., Ltd.) is selected and combined with a diphenoquinone derivative, particularly a non-symmetrical substituted diphenoquinone derivative and the mixture is dispersed in a resin medium together with a charge generating agent, there is obtained a single layer dispersed-type organic photosensitive material having a reduced residual potential and an improved sensitivity. The research works of the present inventors have led to the discovery that there is a certain relation between the ionized potential of a hole transporting agent to be combined with a diphenoquinone derivative and the residual potential of the photosensitive layer (the lower the residual potential is, the apparent sensitivity becomes larger), and within a specified range of ionized potentials, the residual potential becomes a minimum amount or a value near it.

Figure 1:
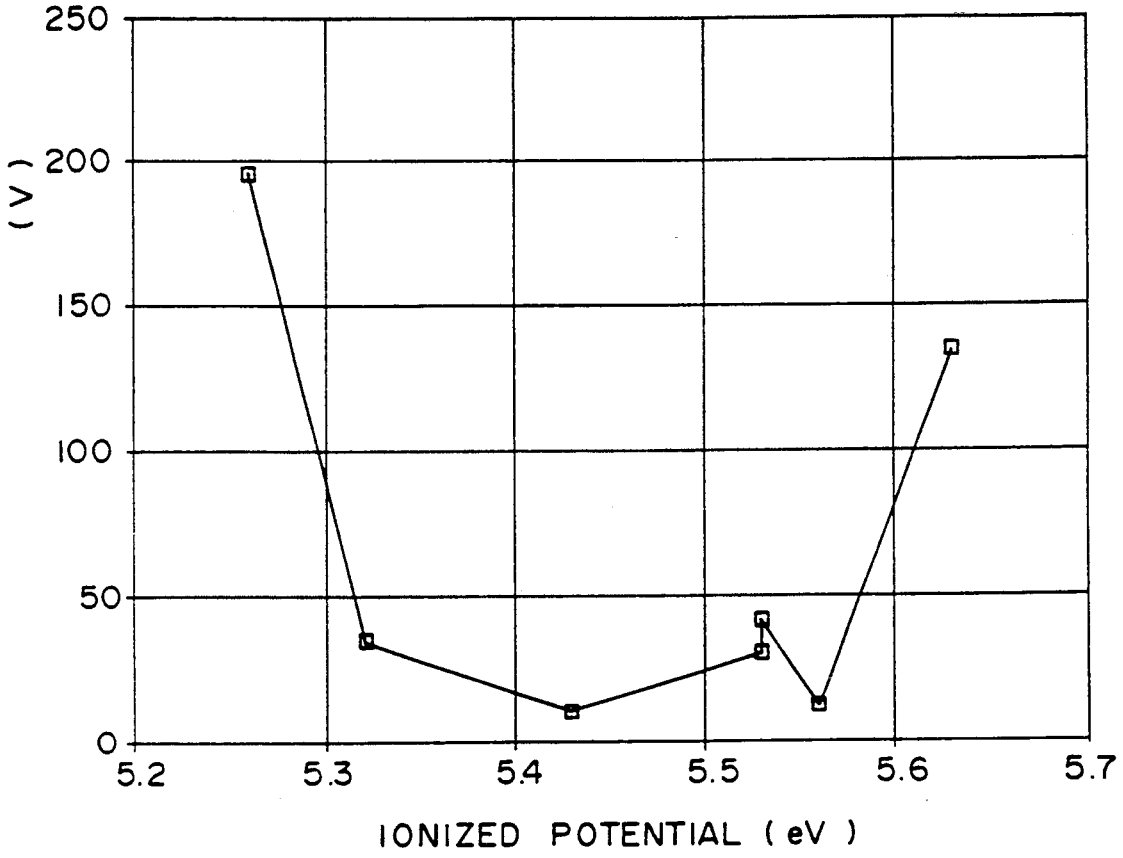
FIG. 1 is a diagram showing the relation of the ionized potential of the positive hole transporting agent and the residual potential at the time of charging and exposure in the single layer dispersed-type organic photosensitive material.

FIG. 1 is obtained by plotting the relation of the ionizing potential of the hole transporting agent and the residual potential at the time of charging and exposure with reference to single layer dispersed-type organic photosensitive material containing a charge generating agent, the diphenoquinone derivative and various hole transporting agents in a specified quantitative ratio in the resin (the details will be shown in the Examples). It is seen from FIG. 1 that by specifying the ionized potential of the hole transporting substance to be combined with the diphenoquinone derivative within the range determined in the present invention, the residual potential can be inhibited under a smaller level and the sensitivity can be improved as compared with other cases.

Figure 2:
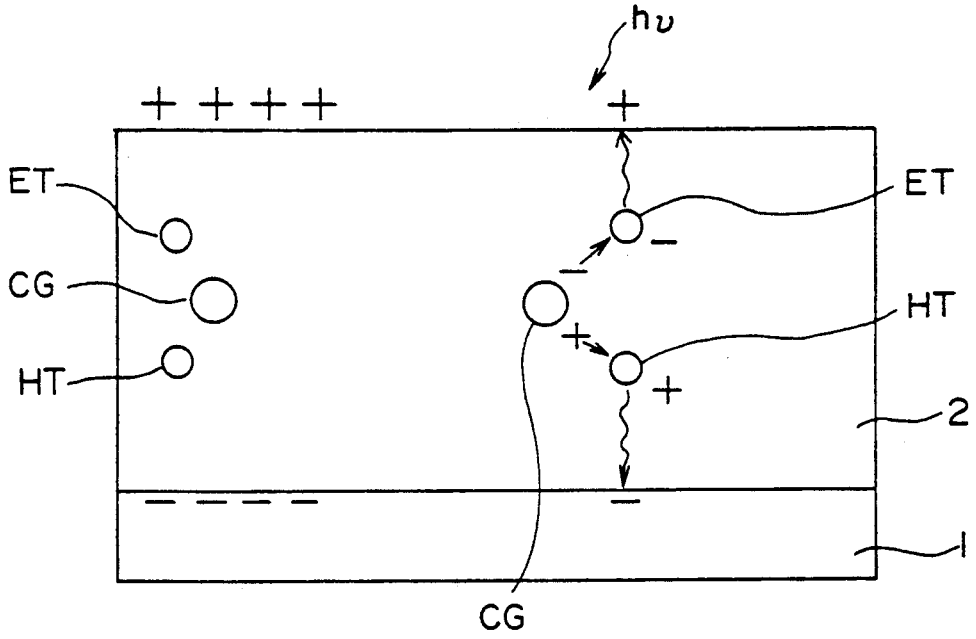
FIG. 2 is a diagram illustrating the principle of a charged image forming of the single layer dispersed-type organic photosensitive material of this invention.

In FIG. 2 illustrating the principle of forming a charged image in a single layer dispersed-type organic photosensitive material, a single layer dispersed-type organic photosensitive layer 2 is provided on the electroconductive substrate 1. In this organic photosensitive layer 2, the charge generating agent CG, the electron transporting agent ET comprising the diphenoquinone derivative, and the hole transporting agent HT are dispersed. By a charging step prior to exposure, the surface of the organic photosensitive material layer 2 is charged positively (+), and in the surface of the electroconductive substrate is induced a negative charge (−). When light (h $\nu$) is irradiated in this state, a charge is generated in the charge generating agent CG, and electrons are injected into the electron transporting agent ET and move to the surface of the organic photosensitive material layer 2 to negate the positive charge (+). On the other hand, the hole (+) is injected into the hole transporting agent HT, and without being trapped on the way, it moves to the surface of the electroconductive substrate 1, and is negated by a negative charge (−).

The use of the diphenoquinone derivative as the electron transporting agent ET in this invention is due to the fact that it has excellent electron transportability. This is probably because quinone-type oxygen atoms having good electron acceptability are bonded to both ends of the molecular chain, conjugated double bonds exist over the entire molecular chain, movement of electrons within the structure is easy and the donation and acceptance of electrons are carried out easily.

In the present invention, the use of the hole transporting agent HT having the above-specified ionized potential leads to the phenomenon wherein the residual potential is reduced and the sensitivity is improved. Although not limited to the following description, it may be considered to be as follows. The ease of injecting a charge from the charge generating agent CG to the hole transporting agent HT is intimately related to the ionized potential of the hole transporting agent HT. When the ionized potential of the hole transporting agent HT is larger than the range specified in this invention, the degree of injection of a charge from the charge generating agent CG to the hole transporting agent HT becomes lower or since the degree of donation and acceptance of the holes between the hole transporting agents HT becomes lower, the sensitivity is thought to be decreased.

On the other hand, in a system in which both the hole transporting agent HT and the electron transporting agent ET are present together as the electron transporting agent, an interaction between the two, more specifically the formation of a charge transfer complex must be taken care of. When such a complex is formed between the two, re-bonding between a hole and an electron occurs, and the movement degree of electric charge on the whole decreases. If the ionized potential of the hole transporting agent HT is smaller than the range of the present invention, there is a large tendency of forming a complex with the electron transporting agent ET. This results in the re-binding of an electron and a hole. Hence, an apparent quantum yield decreases, and this leads to a decrease in sensitivity.

In the present invention, the use of the non-symmetrically substituted diphenoquinone as a diphenoquinone derivative, especially the diphenoquinone of formula (1), (2) or (3), brings about dual advantages. Firstly, since the diphenoquinone has too symmetrical and rigid molecular structure, it has a low solubility in the solvent used for formation of a photosensitive layer, and also has a problem of low solubility in the resin which becomes a photosensitive layer medium. By introducing a substituent such as an alkyl or aryl group into this diphenoquinone in a non-symmetrical manner, the solubility in the solvent and the solubility in the resin medium are improved, and by dispersing the electron transporting agent in a high concentration, the transportability of electrons can be improved. Secondly, by introducing a substituent, especially a bulky substituent, into a diphenoquinone, steric hindrance can be imparted to this derivative and a tendency of forming a complex with the hole transporting agent HT is inhibited. The sensitivity can be improved.

In the single layer dispersed-type organic photosensitive material, a hole transporting agent to be combined with the diphenoquinone derivative has an ionized potential of 5.3 to 5.6 eV. In this regard, the charge generating agent having an ionized potential balanced with the hole transporting agent, namely an ionized potential of 5.3 to 5.6 eV, especially 5.32 to 5.38 eV, is used. This is desirable in inhibiting the residual potential and improving the sensitivity.

Electron Transferring Agent

As the diphenoquinone derivative used as an electron transporting agent in this invention, there may be cited one having the general formula (4)

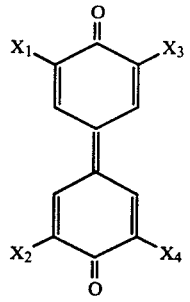

(4)

wherein each of $X_1$, $X_2$, $X_3$ and $X_4$ is a hydrogen atom, an alkyl group, a cycloalkyl group, an aryl group or an aralkyl group.

Suitable examples, not limited to these, include 2,6-dimethyl-2', 6'-di-t-butyl diphenoquinone, 2,2'-dimethyl-6,6'-di-t-butyl diphenoquinone, 2,6'-dimethyl-2',6-di-t-butyl diphenoquinone, 2,6,2',6'-tetramethyl diphenoquinone, 2,6,2',6'-tetra-t-butyl diphenoquinone, 2,6,2',6'-tetraphenyl diphenoquinone, and 2,6,2',6'-tetracyclohexyl diphenoquinone. The diphenoquinone derivatives having substituents satisfying the following formulas (I), (II) and (III) have a low molecular symmetry and therefore, a low interaction between molecules, and have excellent solubility, and are preferred.

(carbon number of $X_1$ = carbon number of $X_3$)

(carbon number of $X_2$ = carbon number of $X_3$) (I)

(carbon number of $X_1$ = carbon number of $X_2$)

(carbon number of $X_3$ = carbon number of $X_4$) (II)

(carbon number of $X_1$ = carbon number of $X_4$)

(carbon number of $X_2$ = carbon number of $X_3$) (III)

The diphenoquinone derivatives may be used singly or as a mixture of two or more.

In the present invention, by using the above diphenoquinone derivatives in combination with a benzoquinone derivative, the residual potential can be markedly decreased and the sensitivity can be further increased. When these two compounds are used together, the diphenoquinone having a relatively large molecular weight and the benzoquinone having a relatively small molecular weight coexist in the resin binder. Thus, as compared with the case of using the diphenoquinone derivative alone, the hopping distance becomes shorter and electron transporting tends to take place easily even in a low electric field. Hence, the residual potential can be markedly decreased, and the sensitivity can be remarkably increased. The diphenoquinone derivative and the benzoquinone derivative are common in electronical properties, for example, having a reduction potential of −0.7 to −1.3. Using them in combination prevents the formation of a trap in the photosensitive layer, and improves the movement degree of electrons.

Preferably, in the present invention, the diphenoquinone derivative (A) and the benzoquinone derivative (B) are used in a A:B weight ratio of 2:1 to 10:1. An example of the benzoquinone derivative is a compound of the formula (5)

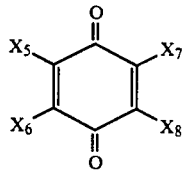

wherein $X_5$ to $X_8$ are hydrogen atoms or electron donor groups under such a condition that at least one of them is an electron donor group such as an alkyl group, an alkoxy group or an amino group.

Examples of the electron donor group include alkyl groups such as a methyl group, an ethyl group, a propyl group and a butyl group; aryl groups such as a phenyl group, tolyl group and a cumyl group; alkoxy groups such as a methoxy group, an ethoxy group and a propoxy group; and amino groups such as a dimethylamino group and a diethylamino group. It is not limited by these examples. The number of electron donor groups is at least 1, preferably 2 to 4. The benzoquinone derivatives most preferably used in this invention are tetramethyl-p-benzoquinone and 2,6-di-tert-butyl-p-benzoquinone.

Hole Transporting Agent

Any desired hole transporting agents which satisfy the above conditions may be used in this invention. Nitrogen-containing cyclic compounds and condensed polycyclic compounds having an ionized potential of 5.3 to 5.6 eV, such as oxadiazole compounds, styryl compounds, carbazole compounds, organic polysilane compounds, pyrazoline compounds, hydrazone compounds, triphenylamine compounds, indole compounds, oxazole compounds, isooxazole compounds, triazole compounds, thiadiazole compounds, imidazole compounds, pyrazole compounds and triazole compounds, may be cited. Those having an electric field strength of $3\times10^5$ V/cm and a movement degree of at least $10^{-6}$ Vcm are particularly preferred.

Specific examples of the hole transporting agent preferably used in this invention include 1,1-bis(p-diethylaminophenyl)-4,4-diphenyl-1,3-butadiene, N,N'-bis-(o,p-dimethylphenyl)-N,N'-diphenylbenzidine, 3,3'-dimethyl-N,N,N',N'-tetrakis-4-methylphenyl(1,1'-biphenyl)-4,4'-diamine, N-ethyl-3-carbazolyaldehyde-N,N'-diphenylhydrazone, and 4-(N,N-bis(p-tolyl-)amino)-phenylstilbene, although not limited to them.

Charge Generating Agent

Examples of the charge generating agent include, for example, selenium, selenium-tellurium, amorphous silicon, pyrylium salts, azoic pigments, disazoic pigments, anthanthrone-type pigments, phthalocyanine-type pigments, indico-type pigments, threne-type pigments, toluidine-type pigments, pyrazoline-type pigments, perylene-type pigments and quinacridone-type pigments. They are used singly or as a mixture of two or more so that they have an absorption wavelength range in a desired region. Those having an ionized potential of 5.3 to 5.6 eV are preferred. Especially preferred are X-type metal-free phthalocyanine and oxotitanyl Phthalocyanine.

Binder Resins

Various resins may be used as a resin medium in which the above agents are dispersed. Examples may include olefin-type polymers such as styrene-type polymers, acrylic-type polymers, styrene-acrylic type polymers, ethylene-vinyl acetate copolymer, polypropylene and ionomer, and photocurable resins such as polyvinyl chloride, vinyl chloride-vinyl acetate copolymer, polyesters, alkyd resins, polyamides, polyurethanes, epoxy resins, polycarbonates, polyallylates, polysulfone, diallyl phthalate resins, silicone resins, ketone resin, polyvinyl butyral resin, polyether resins, phenol resins and epoxy arylate. Preferred binding resins are the styrene-type polymers, acrylic polymers, styrene-acrylic type polymer, polyesters, alkyd resins polycarbonates and polyallylates.

Preparation of the Single Layer Dispersed-Type Photosensitive Material

The single layer dispersed-type photosensitive material of this invention may be obtained by uniformly mixing the above-mentioned agents and the binder resin using a suitable solvent by a known method, for example, using a roll mill, a ball mill, an attriter, a paint shaker, or an ultrasonic disperser, and coating and drying the mixture on an electroconductive substrate to form a photosensitive layer. In the photosensitive material of the present invention, the charge generating agent is included preferably in an amount of 0.1 to 5% by weight, especially 0.25 to 2.5% by weight, based on the solid. The diphenoquinone derivative (ET) and the hole transporting agent (HT) are preferably contained in an amount of 5 to 50% by weight, especially 10 to 40% by weight, and in an amount of 5 to 50% by weight, especially 10 to 40% by weight, based on the solid respectively in the photosensitive layer. Furthermore, the weight ratio of ET:HT is most preferably 1:9 to 9:1, especially 2:8 to 8:2.

The photosensitive layer may contain known additives such as an anti-oxidant, a radical scavenger, singlet quencher, an UV absorber, a softening agent, a surface reform agent, an anti-foamer, a extender, a thickener, a dispersion stabilizer, a wax, an acceptor, and a donor in amounts which do not adversely affect its electrophotographic properties.

According to this invention, if a sterially hindered phenol-type anti-oxidant is incorporated in an amount of 0.1 to 50% by weight based on the total solids content, the durability of the photosensitive layer can markedly be improved without adversely affecting the electrophotographic properties of the photosensitive layer. Suitable anti-oxidants are as shown below.

(2,6-di-t-butyl-p-cresol)

-continued

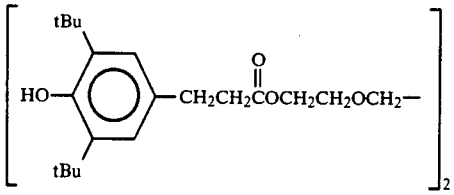

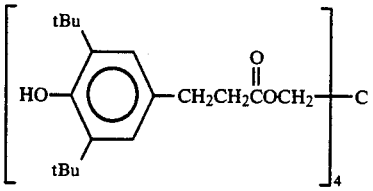

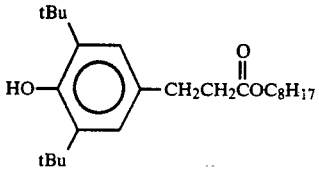

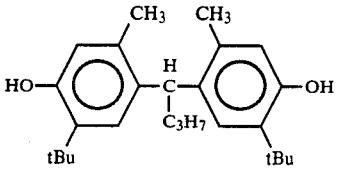

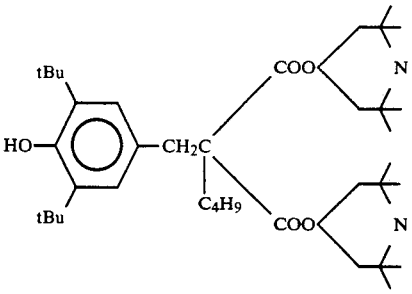

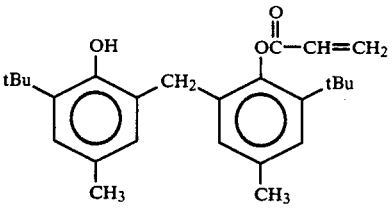

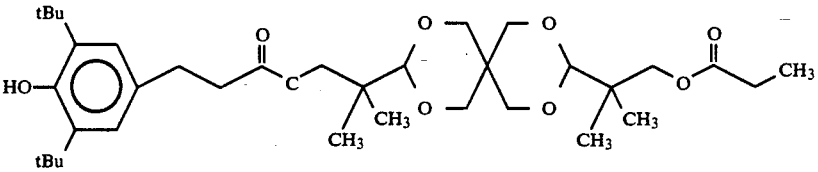

Various organic solvents can be used to form coating solution. They include, for example, alcohols such as methanol, ethanol, isopropanol, and butanol, aliphatic hydrocarbons such as n-hexane, octane, and cyclohexane, aromatic hydrocarbons such as benzene, toluene and xylene, halogenated hydrocarbons such as dichloromethane, dichloroethane, carbon tetrachloride, and chlorobenzene, ethers such as dimethyl ether, diethyl ether, tetrahydrofuran, ethyleneglycol dimethyl ether and diethylenglycol dimethyl ether, ketones such as acetone, methyl ethyl ketone, and cyclohexanone, esters such as ethyl acetate and methyl acetate, dimethylformamide and dimethylsuloxide. They may be used singly or in a mixture of two or more. The solid concentration of the coating solution is generally 5 to 50%.

Various materials having electroconductivity may be used as the electroconductive substrate. For example, they may be a single metal element such as aluminum, copper, tin, platinum, gold, vanadium, strainless steel, and brass, plastic materials laminated or vapor-deposited with the above metals, and glass coated with tin oxide or indium oxide.

Another advantage of this invention is that since the single layer-dispersed type photosensitive material of the invention is free from the development of interference fringe, an ordinary aluminum tube, especially a tube on which alumite-treatment was conducted so as to form a film thickness of 1 to 50 μm can be used.

The thickness of the photosensitive layer is not particularly limited, but desirably it is generally 5 to 100 μm, especially 10 to 50 μm.

Laminated-Type Photoconductive Material

In the present invention, including the above-mentioned non-symmetrically substituted-type diphenoquinone derivative in a concentration of 10 to 60% by weight in the binder resin and using it as an electron transporting layer form a positively chargeable organic laminated photosensitive material which has a high initial potential, a decreased residual potential, and can further increase sensitivity. Furthermore, by combining a charge generating agent layer containing a charge generating agent having an ionized potential of 5.3 to 5.6 eV with the above electron transporting layer, the residual potential of the photosensitive material can be further decreased, and the sensitivity can further be increased.

Figure 3:
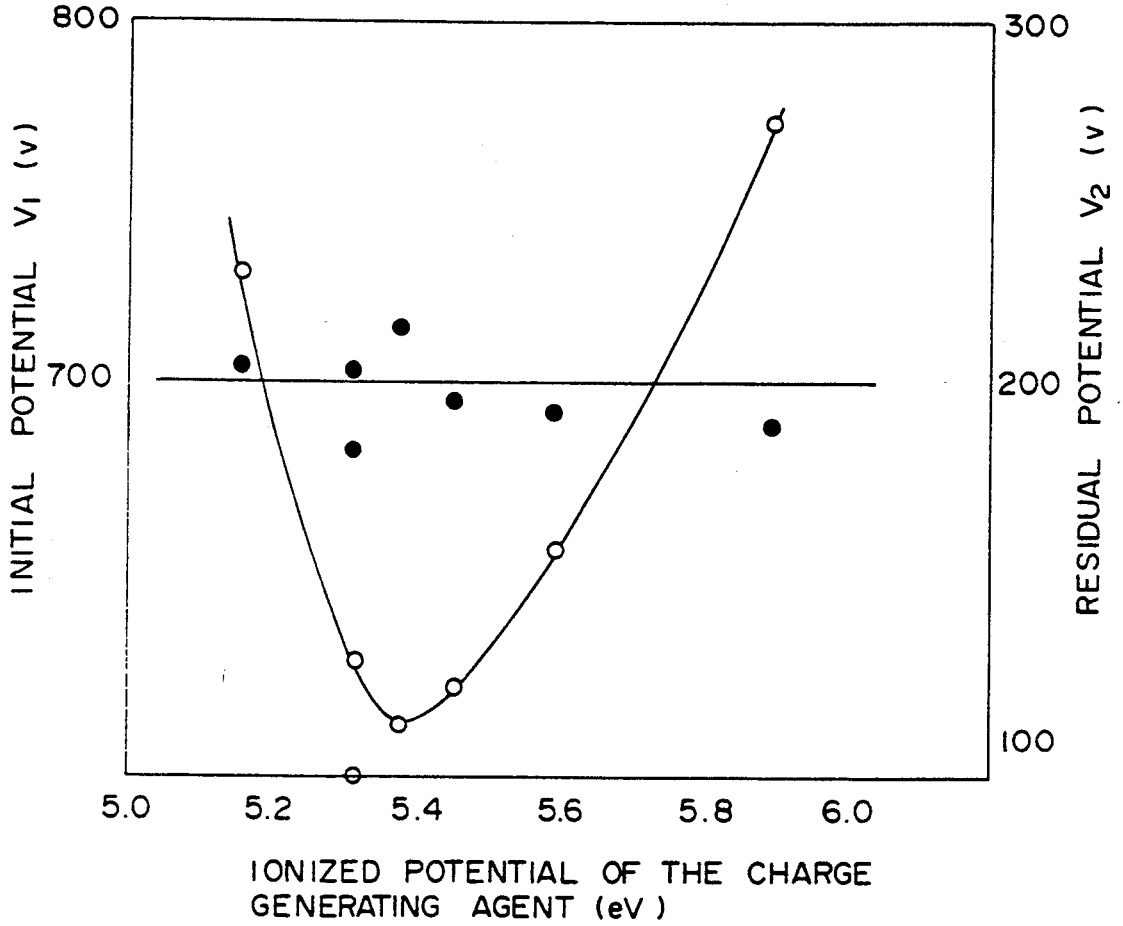
FIG. 3 is a diagram illustrating an example of the laminated-type photosensitive material of this invention.

In FIG. 3 showing an example of the laminated-type photosensitive material of the invention, the charge generating layer 4 and the charge transporting layer 5 are provided on the electroconductive substrate 1. A charge generating agent CG is present in the charge generating layer 4, and the electron transporting agent ET is dispersed in the charge transporting layer 5. By a charging step prior to exposure, the surface of the charge transporting layer 5 is charged positively (+), and the surface of the electroconductive substrate 1 is induced to a negative charge (−). When light (h $\nu$) is irradiated in this state, a charge is generated on the charge generating agent CG. An electron is injected into the charge transporting layer 5, and moves to the surface by the action of the electron transporting agent ET to negate the positive charge (+). On the other hand, the hole (+) negates the negative charge (−) on the surface of the electroconductive substrate 1. The foregoing results in the formation of a charged image.

Figure 4:
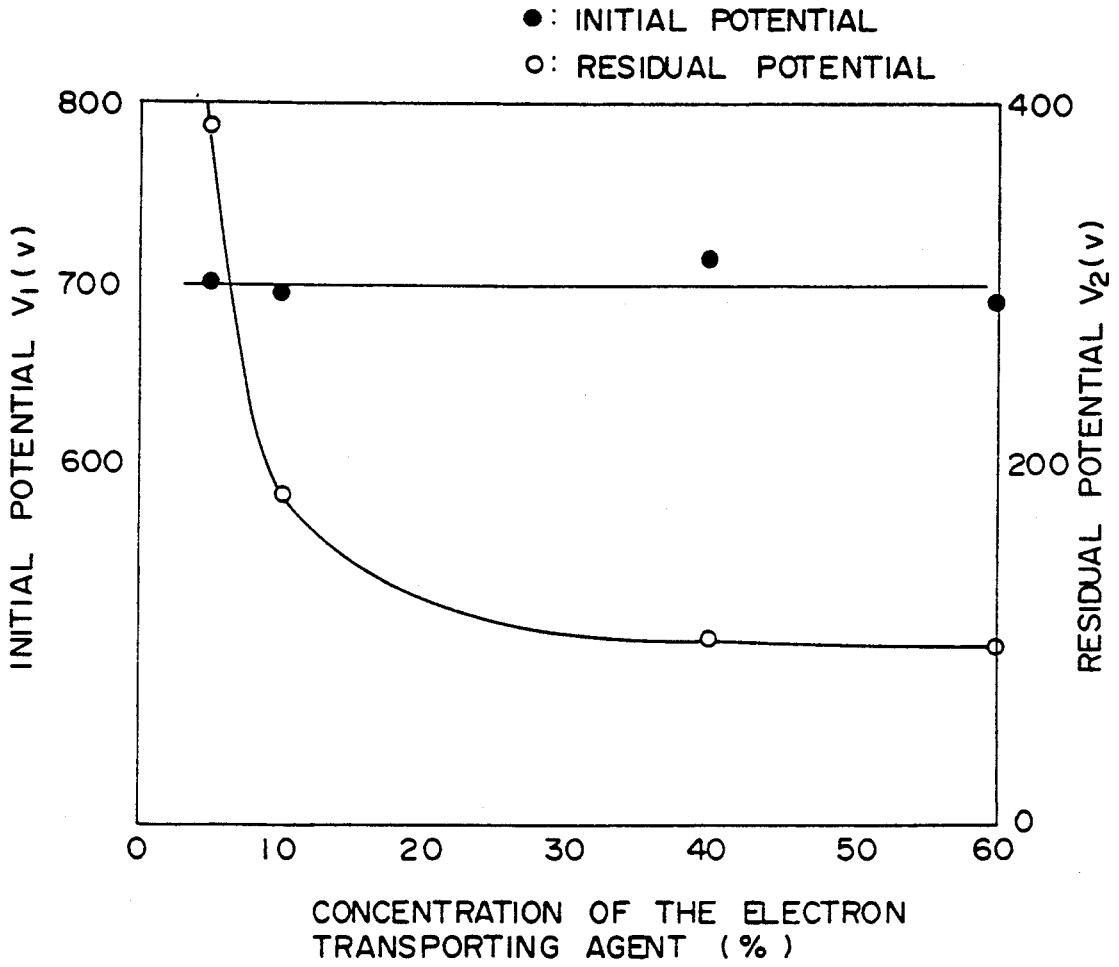
FIG. 4 is a diagram showing the relation between the concentration of a non-symmetrically substituted diphenoquinone derivative in the electron transferring layer and the charging initial potential and the residual potential at the time of charging and exposure in the laminated photosensitive material of this invention.

FIG. 4 is a plot showing a relation between the concentration of the non-substituted diphenoquinone derivative (abscissa) in the electron transporting layer and the initial potential of charging (left ordinate) and the residual potential at the time of charging and exposure (right ordinate) with respect to an organic laminated photosensitive material (for details, see the Examples given below) composed of a laminate of the charge generating layer and the electron transporting layer, in which the proportion of the non-symmetrically substituted diphenoquinone derivative in the electron transporting layer is varied. From FIG. 4, it is understood that by determining the concentration of the non-symmetrical diphenoquinone derivative within the range specified in this invention, the residual potential can be inhibited to a smaller level and the sensitivity can be improved while the initial potential is maintained at a higher level.

The charge generating agent used in the charge generating layer 4 in the laminated organic photosensitive material of this invention has an ionized potential of 5.3 to 5.6 eV. The charge generating layer 4 is formed by coating and drying a coating composition prepared by dispersing the charge generating agent in a solution of the above binder resin. The charge generating agent is preferably dispersed in the charge generating layer 4 in an amount of 10 to 80% by weight, especially 20 to 70% by weight, based on the solids content. The thickness of the charge generating layer 4 is preferably 0.05 to 5 μm, especially 0.1 to 1 μm.

The electron transporting layer 5 is formed by coating and drying a coating composition obtained by dispersing the non-symmetrical diphenoquinone derivative in the binder resin on the charge generating layer 4. This diphenoquinone derivative is used in an amount of 10 to 60% by weight, especially 20 to 50% by weight, as a total solids content of the diphenoquinone derivative and the binder resin.

So long as the diphenoquinone derivative is dispersed in the above amount in the electron transporting layer 5, a benzoquinone derivative having a relatively small molecular weight may be simultaneously dispersed as in the case of the single layer dispersed-type organic photosensitive material.

Known various additives may be compounded and dispersed in each of the above layers in amounts which do not adversely affect the electrophotographic properties. Especially, in the charge transporting layer 5, the sterically hindered phenol-type anti-oxidant illustrated under the headline of the single layer dispersed-type organic photosensitive material above may be added in an amount of 0.1 to 50% by weight based on the total solids content to improve durability.

EXAMPLES

In the following Examples, the following charge generating agents, hole transporting agents, and electron transporting agents were used.

Examples 1 to 42 refer to the single layer dispersed-type organic photosensitive materials, and Examples 43 to 54, to the laminated-type organic photosensitive materials.

Charge Generating Agents

I: X-type metal-free phthalocyanine
(IP=5.38 eV)

II: β-type metal-free Phthalocyanine
(IP=5.32 eV)

III: oxotitanyl Phthalocyanine
(IP=5.32 eV)

IV: 1,4-dithioketo-3,6-diphenyl-pyrrolo-(3.4-c)pyrrolopyrrole
(IP=5.46 eV)

V: N,N-bis(3',5'-dimethylphenyl)perylene 3,4,9,10-tetracarboxydiimide
(IP=5.60 eV)

VI: 2,7-bis(2-hydroxy-3-(2-chlorophenyl-carbamoyl)-1-naphylazo)fluorenon
(IP=5.90 eV)

VII: Mg phthalocyanine
(IP=5.16 eV)

The term IP is an abbreviation of ionized potential.

Hole Transporting Agents (a) 1,1-bis(p-diethylaminophenyl)-4,4-diphenyl-1,3-butadiene
(IP=5.32 eV, drift movement degree=$7.5\times10^{-6}$ $cm^2/V.sec$)
(b) N,N'-bis(o,p-dimethylphenyl)-N,N'-diphenylbenzidine
(IP=5.43 eV, drift movement degree=$2.8\times10^{-5}$ $cm^2/V.sec$)
(c) 3,3'-dimethyl-N,N,N',N'-tetrakis-4-methylphenyl(1,1'-biphenyl)-4,4'-diamine
(IP=5.56 eV, drift movement degree=$5.1\times10^{-5}$ $cm^2/V.sec$)
(d) N-ethyl-3-carbozolylaldehyde-N,N'-diphenylhydrazone
(IP=5.53 eV, drift movement degree=$3.2\times10^{-5}$ $cm^2/V.sec$)
(e) 4-(N,N-bis(p-toluyl)amino)-β-phenyl-stilbene
(IP=5.53 eV, drift movement degree=$3.5\times10^{-5}$ $cm^2/V.sec$)
(f) N,N,N',N'-tetrakis(3-methylphenyl)-1,3-diaminobenzene
(IP=5.63 eV, drift movement degree=$3.0\times10^{-5}$ $cm^2/V.sec$)
(g) N,N-diethylaminobenzaldehydediphenyl-hydrazone
(IP=5.26 eV, drift movement degree=$1.0\times10^{-6}$ $cm^2/V.sec$)
(h) N,N-dimethylaminobenzaldehydediphenyl-hydrazone
(IP=5.32 eV, drift movement degree=$2.0\times10^{-7}$ $cm^2/V.sec$)

Electron Transporting Agents A (1) 2,6,2',6'-tetraphenyldiphenoquinone
(2) 2,6,2',6'-tetra-tert-butyl-diphenoquinone
(3) 2,6-dimethyl-2',6'-ditert-butyl-diphenoquinone
(4) 2,2'-dimethyl-6,6'-ditert-butyl-diphenoquinone
(5) trinitrofluolenone (TNF)
(6) 2,6'-diphenyl-2',6-ditert-butyl-diphenoquinone Electron Transporting Agents B (1) p-benzoquinone
(2) tetramethyl-p-benzoquinone
2,6-ditert-butyl-p-benzoquinone The reduction potentials of the electron transporting agents above were carried out in the following manner.

As a measuring solution, 0.1 mol of an electrolyte (tert-butyl ammonium perchlorate), 0.1 mol of the measuring material (each electron transporting agent), and 1 liter of a solvent (dichloromethane) were mixed, and the mixture was subjected to cyclic voltermetry using a three-pole type instrument (acting electrode: a glassy-carbon electrode; a counter electrode: a platinum electrode; reference electrode: silver-silver nitrate electrode (0.1 mol/liter $AgNO_3$-acetonitrile solution)). From the resulting measurement data, the oxidation reduction potential was determined.

EXAMPLES 1 TO 12 AND COMPARATIVE EXAMPLES 1 AND 2

One part by weight of each of the charge generating agents shown in Tables 1 and 2, 60 parts by weight of each of the hole transporting agents shown in Table 1, 40 parts by weight of each of the diphenoquinone derivatives shown in Table 1 as the electron transporting agents A, 100 parts by weight of polycarbonate as the binder and predetermined amount of dichloromethane were mixed and dispersed by using a ball mill to prepare a single layer-type photosensitive layer coating solution. The resulting solution was coated on an aluminum foil by a wire bar, and dried by hot air at 60° C. for 60 minutes to form a single layer-type electrophotographic material having a film thickness of 15 to 20 μm.

EXAMPLE 13

Except that the amount of the compound shown in Table 1 as the charge generating agent was changed to 0.2 part by weight, the procedure of Table 3 was repeated to form a single layer-type electrophotographic material.

EXAMPLE 14

Except that the amount of the compound shown in Table 1 as the charge generating agent was changed to 0.5 part by weight, the same procedure as in Example 3 was repeated to form a single layer-type electrophotographic material.

EXAMPLE 15

Except that the amount of the compound shown in Table 1 as the charge generating agent was changed to 2 parts by weight, the same procedure as in Example 3 was repeated to form a single layer-type electrophotographic material.

EXAMPLE 16

Except that the amount of the compound shown in Table 1 as the charge generating agent was changed to 3.5 parts by weight, the same procedure as in Example 3 was repeated to form a single layer-type electrophotographic material.

EXAMPLE 17

Except that the amount of the compound shown in Table 1 as the charge generating agent was changed to 5 parts by weight, the same procedure as in Example 3 was repeated to form a single layer-type electrophotographic material.

EXAMPLE 18

Except that the amount of the compound shown in Table 2 as the charge generating agent was changed to 10 parts by weight, the same procedure as in Example 3 was repeated to form a single layer-type electrophotographic material.

EXAMPLE 19 TO 21

Except that the amount of the diphenoquinone shown in Table 2 as the electron transporting agent was changed to 30 parts by weight, the same procedure as in Example 3 was repeated to form a single layer-type electrophotographic material.

EXAMPLE 22

Except that the thickness of the single layer-type photosensitive layer was changed to about 10 μm, the same procedure as in Example 3 was repeated to form a single layer-type electrophotographic material.

EXAMPLE 23

Except that the film thickness of the single layer-type photosensitive layer was changed to about 30 μm, the same procedure as in Example 3 was repeated to form a single layer-type electrophotographic material.

EXAMPLE 24

Except that the thickness of the single layer-type photosensitive layer was changed to about 40 μm, the same procedure as in Example 3 was repeated to form a single layer-type electrophotographic material.

EXAMPLE 25

Except that 10 parts by weight of 2,6-ditert-butyl-p-cresol was added as an antioxidant, the same procedure as in Example 3 was repeated to form a single layer-type electrophotographic material.

COMPARATIVE EXAMPLE 3

Except that 5 parts by weight of TNF was used as the electron transporting agent, Example 3 was repeated to obtain a single layer-type electrophotographic material.

COMPARATIVE EXAMPLE 4

Except that no electron transporting agent was used, Example 3 was repeated to prepare a single layer-type electrophotographic material.

COMPARATIVE EXAMPLE 5

Except that no hole transporting agent was used, Example 3 was repeated to obtain a single layer-type electrophotographic material. (Evaluation of the electrophotographic material)

By using an electrostatographic copying test apparatus (made by Kawaguchi Electric Co., Ltd., EPT-8100), a voltage was impressed to the photosensitive material obtained in each of Examples and Comparative Examples to charge it positively, a white halogen light was used as a light source to measure its electrophotographic properties. The results are shown in Tables 1 and 2.

In the Tables, VI(V) shows the initial surface potential of the photosensitive material when voltage was applied to charge the electrophotographic material, and $E_{\frac{1}{2}}$ ($\mu J.cm^2$) shows the half decay exposure amount calculated from the time required for the surface potential VI(V) to become ½. V2(V) in the Tables shows the surface potential after 5 seconds from the start of exposure as a residual potential.

EXAMPLES 26 TO 30

Except that the photosensitive materials obtained in Examples 1 to 5 were charged negatively, the electrophotographic materials were evaluated in the same way as above. The results are shown in Table 2.

Printability

The photosensitive materials obtained in Examples 3 and 25 and Comparative Example 1 were mounted on the copying machine, and subjected to a 1000 cycle copying step. Thereafter, the surface potential V 1000 (V) was measured. The results are shown in Table 3.

As can be seen from Tables 1 and 2, the electrophotosensitive materials of the invention have a reduced residual potential, and an increased sensitivity. It is further seen from Table 3 that the electrophotosensitive material of Example 25 containing a sterically hindered phenol-type antioxidant among the electrophotographic photosensitive materials of the invention had good charging properties in using it repeatedly 1000 times. On the other hand the electrophotosensitive material of Comparative Example 2 in which the hole transporting agent has an ionized potential outside 5.3 to 5.6 eV has a large residual potential and poor sensitivity. As can be seen from Table 3, the electrophotosensitive material of Comparative Example 1 has decreased charging properties when it is used repeatedly 1000 times. The electrophotosensitive materials of Comparative Examples 3 and 4 in which diphenoquinone derivatives were not used as electron transporting agents and the electrophotosensitive material of Comparative Example 5 not containing a hole transporting agent had a large residual potential and did not decay by exposure.

TABLE 1

| | CG | HT | ET-A | $V_1$ (V) | $V_2$ (V) | $E_{\frac{1}{2}}$ ($\mu J/cm^2$) |
|---|---|---|---|---|---|---|
| Example 1 | I | (a) | 3 | +705 | +35 | 1.8 |
| Example 2 | I | (b) | 3 | +716 | +11 | 1.1 |
| Example 3 | I | (c) | 3 | +723 | +13 | 1.2 |
| Example 4 | I | (d) | 3 | +711 | +42 | 2.1 |
| Example 5 | I | (e) | 3 | +697 | +31 | 1.6 |
| Example 6 | I | (h) | 3 | +710 | +105 | 1.7 |
| Example 7 | II | (c) | 3 | +686 | +57 | 1.9 |
| Example 8 | III | (c) | 3 | +713 | +29 | 1.5 |
| Example 9 | IV | (c) | 3 | +632 | +43 | 1.8 |
| Example 10 | V | (c) | 3 | +648 | +98 | 11.5 |
| Example 11 | VI | (c) | 3 | +708 | +103 | 13.4 |
| Example 12 | VII | (c) | 3 | +719 | +121 | 5.3 |
| Example 13 | I | (c) | 3 | +721 | +129 | 3.0 |
| Example 14 | I | (c) | 3 | +719 | +53 | 1.4 |
| Example 15 | I | (c) | 3 | +705 | +10 | 1.2 |
| Example 16 | I | (c) | 3 | +697 | +9 | 1.1 |
| Example 17 | I | (c) | 3 | +683 | +6 | 1.2 |

TABLE 2

| | CG | HT | ET-A | $V_1$ (V) | $V_2$ (V) | $E_{\frac{1}{2}}$ ($\mu J/cm^2$) |
|---|---|---|---|---|---|---|
| Example 18 | I | (c) | 3 | +672 | +4 | 1.1 |
| Example 19 | I | (c) | 1 | +703 | +54 | 2.0 |
| Example 20 | I | (c) | 2 | +709 | +49 | 1.8 |
| Example 21 | I | (c) | 4 | +699 | +30 | 1.6 |
| Example 22 | I | (c) | 3 | +675 | +45 | 1.7 |
| Example 23 | I | (c) | 3 | +723 | +23 | 1.5 |
| Example 24 | I | (c) | 3 | +721 | +35 | 1.9 |
| Example 25 | I | (c) | 3 | +713 | +23 | 1.2 |
| Example 26 | I | (a) | 3 | −712 | −43 | 3.1 |
| Example 27 | I | (b) | 3 | −687 | −22 | 2.5 |
| Example 28 | I | (c) | 3 | −703 | −24 | 2.5 |
| Example 29 | I | (d) | 3 | −721 | −55 | 2.9 |
| Example 30 | I | (e) | 3 | −693 | −64 | 2.8 |
| Comp. Ex. 1 | I | (f) | 3 | +696 | +135 | 2.0 |
| Comp. Ex. 2 | I | (g) | 3 | +702 | +196 | 3.5 |
| Comp. Ex. 3 | I | (c) | 5 | +714 | +321 | *1 |
| Comp. Ex. 4 | I | (c) | — | +704 | +453 | *1 |
| Comp. Ex. 5 | I | — | 3 | +709 | +523 | *1 |

Comp. Ex.: Comparative Example
*1: Because decay did not occur by exposure, measurement was impossible

TABLE 3

| | CG | HT | ET-A | $V_1$ (V) | $V_{1000}$ (V) |
|---|---|---|---|---|---|
| Example 3 | I | (c) | 3 | +723 | +611 |
| Example 25 | I | (c) | 3 | +713 | +695 |
| Comp. Ex. 1 | I | (f) | 3 | +701 | +473 |

Comp. Ex.: Comparative Example

EXAMPLES 31 TO 34 AND 39 to 42

Two parts by weight of the compound shown in Table 4 as a charge generating agent, 60 parts by weight of the compound as a hole transporting agent, 40 parts by weight of the diphenoquinone derivative as an electron transporting agent A or B shown in Table 1, 20 parts by weight of the benzoquinone derivative, 100 parts by weight of polycarbonate as a binder, and a specified amount of dichloromethane as a bathing agent were mixed and dispersed by a ball mill to prepare a single layer-type photosensitive coating solution. The prepared solution was coated on an aluminum foil by a wire bar, and dried by a hot air at 60° C. for 60 minutes to form a single layer-type electrophotosensitive material having a film thickness of 15 to 20 μm. Its properties were evaluated.

In the following examples, the electrophotosensitive materials were evaluated in the following manner.

Using an electrostatographic copying test apparatus (made by Kawaguchi Electric Co., Ltd., ESA-8100), an applied voltage was impressed to the electrophotosensitive material to charge it positively or negatively. Using a white halogen light as a light source, electrophotographic properties were measured. The results are shown in Table 4.

V1 in the Table shows the initial surface potential of the photosensitive material charged by applying a voltage. V2 shows the surface potential after 1 second from the starting of exposure as a residual potential. The contrast potential is the difference between V1 and V2.

EXAMPLE 35

Except that the amount of the benzoquinone derivative was changed to 10 parts by weight, Example 31 was repeated to form a single layer-type electrophotosensitive material.

EXAMPLE 36

Except that the amount of the benzoquinone derivative was changed to 5 parts by weight, Example 31 was repeated to form a single layer-type electrophotosensitive material.

EXAMPLE 37

Except that the film thickness of the electrophotosensitive material was changed to about 25 μm, Example 31 was repeated to form a single layer-type electrophotosensitive material.

EXAMPLE 38

Except that the film thickness of the electrophotosensitive material was changed to about 30 μm, Example 31 was repeated to form a single layer-type electrophotosensitive material.

TABLE 4

| | CG | HT | ET-B | ET-A | $V_1$ (V) | $V_2$ (V) | contrast potential (V) |
|---|---|---|---|---|---|---|---|
| Example 31 | I | c | 1 | 3 | +708 | +183 | 505 |
| Example 32 | I | c | 2 | 3 | +721 | +185 | 536 |
| Example 33 | I | c | 3 | 3 | +712 | +201 | 511 |
| Example 34 | I | c | 1 | 3 | −702 | −175 | 527 |
| Example 35 | I | c | 1 | 3 | +711 | +198 | 513 |
| Example 36 | I | c | 1 | 3 | +713 | +215 | 498 |
| Example 37 | I | c | 1 | 3 | +715 | +180 | 535 |
| Example 38 | I | c | 1 | 3 | +733 | +197 | 536 |
| Example 39 | I | c | 1 | 2 | +712 | +241 | 471 |
| Example 40 | I | c | 1 | 6 | +703 | +182 | 521 |
| Example 41 | I | b | 1 | 3 | +706 | +175 | 531 |
| Example 42 | III | c | 1 | 3 | +709 | +172 | 537 |

CG: electron charging agent
HT: hole transporting agent
ET-A: diphenoquinone derivative
ET-B: diphenoquinone derivative In Example 34, negative charging was carried out, and in the other Examples, positive charging was carried out.

It is seen from Table 4 that the electrophotosensitive materials of this invention containing several kinds of electron transporting agents having almost the same levels of reduction potentials can improve the sensitivity by decreasing the residual potentials.

EXAMPLES 43 TO 52 AND COMPARATIVE EXAMPLES 6 TO 9

Two parts by weight of the compound shown in Tables 5 and 6 as the charge generating agent. 1 part by weight of polyvinyl butyral resin as the binder resin, and 120 parts by weight of dichloromethane were dispersed by a ball mill.

The resulting dispersion was coated on an aluminum foil by a wire bar as the electroconductive substrate, and then dried at 100° C. for 1 hour to form a charge generating layer having a thickness of 0.5 μm.

A solution of the compound shown in Tables 5 and 6 in the indicated parts by weight as the electron transporting agent and 100 parts by weight of polycarbonate resin as the binder resin in 800 parts by weight of benzene was coated on the charge generating layer by a wire bar, and dried at 90° C. for 1 hour to form an electron transporting layer having a thickness of 15 μm to form a laminated electrophotosensitive material. The resulting electrophotosensitive material was evaluated as shown in the Example.

EXAMPLE 53

Except that an aluminum tube was used as the electroconductive substrate, Example 43 was repeated to form a laminated electrophotosensitive material.

EXAMPLE 54

Except that 5 parts by weight of 2,6-ditert-butyl-p-cresol was included as an antioxidant in the electron transporting agent, Example 53 was repeated to form a laminated electrophotosensitive material.

The laminated electrophotosensitive materials obtained in Examples 53 and 54 were mounted on an electrophotographic copying machine (trademark LP-X2 made by Mita Industrial Co., Ltd.), and subjected to a 1000 cycle copying step. By using a surface electrometer secured to the electrophotographic copying machine, the surface potentials of the initial $V_0$ (V) of the laminated electrophotosensitive materials obtained in Examples 53 and 54 and the surface potentials of $V_{1000}$ (V) after the 1000 cycle copying step were measured. The results are shown in Table 7.

TABLE 5

| | CGM | CTM | amount added | $V_1$ (V) | $V_2$ (V) | $E_{\frac{1}{2}}$ ($\mu J/cm^2$) |
|---|---|---|---|---|---|---|
| Example 43 | I | 3 | 40 | 715 | 105 | 2.8 |
| Example 44 | II | 3 | 40 | 703 | 123 | 3.0 |
| Example 45 | III | 3 | 40 | 631 | 91 | 2.7 |
| Example 46 | IV | 3 | 40 | 695 | 116 | 2.9 |
| Example 47 | V | 3 | 40 | 692 | 153 | 3.3 |
| Example 48 | I | 4 | 40 | 698 | 111 | 2.9 |
| Example 49 | I | 3 | 10 | 696 | 185 | 3.9 |
| Example 50 | I | 3 | 60 | 691 | 99 | 2.7 |
| Example 51 | VI | 3 | 40 | 688 | 272 | 11.5 |
| Example 52 | VII | 3 | 40 | 705 | 231 | 9.3 |

CGM: charge generating agent
CTM: electron transporting agent
*: Crystal precipitated

TABLE 6

| | CGM | CTM | amount added | $V_1$ (V) | $V_2$ (V) | $E_{\frac{1}{2}}$ ($\mu J/cm^2$) |
|---|---|---|---|---|---|---|
| Comp. Ex. 6 | I | (C) | 40 | * | * | * |
| Comp. Ex. 7 | I | (D) | 40 | * | * | * |
| Comp. Ex. 8 | I | (A) | 5 | 702 | 387 | X |
| Comp. Ex. 9 | I | (A) | 70 | * | * | * |

CGM: charge generating agent
CTM: electron transporting agent
*: Crystal precipitated
X: no half-decay

TABLE 7

| | CGM | CTM | amount added | anti-oxdant | $V_0$ (V) | $V_{1000}$ (V) |
|---|---|---|---|---|---|---|
| Example 53 | I | (A) | 40 | not contained | 705 | 673 |
| Example 54 | I | (A) | 40 | contained | 703 | 698 |

It is seen from Tables 5 and 6 that since the laminated electrophotosensitive materials of this invention contained non-symmetrically substituted diphenoquinone derivatives as the electron transporting agents, they can be included in a high concentration of 40% or 60% by weight in the binder resin as understood from Examples 43 to 48 and 50 to 52. It is clear from each of the Examples that if the content of the diphenoquinone derivative is 10% or 60% by weight, their charging properties, residual potentials and sensitivities become excellent. In comparison with these, it is seen from Comparative Examples 8 and 9 that if the content is less than 10% by weight, the residual potentials were high and the sensitivities were decreased, and if the content is above 60% by weight, the crystals were precipitated, and it was impossible to use these electrophotosensitive materials. Examples 43 to 50 are compared with Examples 51 and 52, it is understood that the use of charge generating agents having an ionized potential of 5.3 to 5.6 eV can obtain laminated electrophotosensitive materials having excellent electrophotographic properties. It is also seen from Table 7 that if an antioxidant is included in the electron transporting layer, the repetition properties are improved.

We claim:

1. An electrophotographic organic photosensitive material comprising a single layer-dispersed type organic photosensitive layer on an electroconductive substrate, the organic photosensitive layer being a composition comprising a charge generating agent, a diphenoquinone derivative as an electron transporting agent and a hole transporting agent having an ionized potential of 5.3 to 5.6 eV dispersed in a resin binder.

2. The organic photosensitive material of claim 1 wherein the charge generating agent is one having an ionized potential of 5.3 to 5.6 eV.

3. The organic photosensitive material of claim 1 wherein the charge generating agent is X-type metal-free phthalocyanine.

4. The organic photosensitive material of claim 1 wherein the charge generating agent is included in an amount of 0.1 to 5% by weight based on the solid content in the organic photosensitive material.

5. The organic photosensitive material of claim 1 wherein the diphenoquinone derivative is a non-symmetrically substituted diphenoquinone derivative.

6. The organic photosensitive material of claim 1 wherein the diphenoquinone derivative is represented by the following formulae

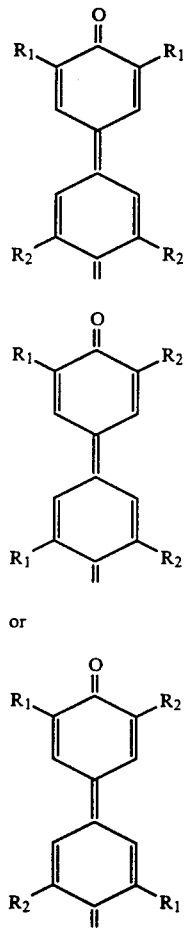

wherein each of $R_1$ and $R_2$ represents an alkyl or aryl group, the group $R_2$ having larger carbon atoms than the group $R_1$.

7. The organic photosensitive material of claim 1 wherein the hole transporting agent is an alkyl-substituted triphenyldiamine.

8. The organic photosensitive material of claim 1 wherein the hole transporting agent has a electrical field strength of $3\times10^5$ V/cm and a hole movement of at least $10^{-6}$ V/cm.

9. The organic photosensitive material of claim 1 wherein the organic photosensitive layer has a film thickness of 5 to 50 $\mu$m.

10. The organic photosensitive material of claim 1 wherein the organic photosensitive layer has a sterically hindered phenolic antioxidant in an amount of 0.1 to 50% by weight based on the total solids content.

11. The organic photosensitive material of claim 1 wherein a benzoquinone derivative is used in combination with the diphenoquinone derivative.

12. The organic photosensitive material of claim 11 wherein the diphenoquinone derivative (A) and the benzoquinone derivative (B) are used in a A:B weight ratio of from 2:1 to 10:1.

13. The organic photosensitive material of claim 1, wherein the hole transporting agent has an ionized potential of 5.32 to 5.38 eV.

14. The organic photosensitive material of claim 1, wherein the charge generating agent has an ionized potential of 5.32 to 5.38 eV.

15. The organic photosensitive material of claim 1 wherein the hole-transporting agent is selected from the group consisting of oxadiazole compounds, styryl compounds, carbazole compounds, pyrazoline compounds, hydrazone compounds, triphenylamine compounds, indole compounds, oxazole compounds, isooxazole compounds, triazole compounds, thiadiazole compounds, imidazole compounds, and pyrazole compounds.

16. The organic photosensitive material of claim 1 wherein the hole transporting agent is an organic polysilane compound.

17. The organic photosensitive compound of claim 16 wherein the organic polysilane compound has an ionized potential of 5.32 to 5.38 eV.

18. The organic photosensitive material of claim 1 wherein the resin binder is selected from the group consisting of styrene polymers, acrylic polymers, styrene-acrylic polymers, ethylene-vinyl acetate copolymer, polypropylene and ionomer resins.

19. The organic photosensitive material of claim 1 wherein the resin binder is selected from the group consisting of polyvinyl chloride, vinyl chloride-vinyl acetate copolymer, polyesters, alkyd resins, polyamides, polyurethanes, epoxy resins, polycarbonates, polyallylates, polysulfone, diallyl phthalate resins, silicone resins, ketone resin, polyvinyl butyral resin, polyether resins, phenol resins and epoxy arylate.

20. The organic photosensitive material of claim 1 wherein the resin binder is selected from the group consisting of styrene polymers, acrylic polymers, styrene-acrylic polymer, polyesters, alkyd resins, polycarbonates and polyallylates.

* * * * *